United States Patent [19]

Stog

[11] 4,238,292

[45] Dec. 9, 1980

[54] APPARATUS FOR WITHDRAWING AND CLEANING EMISSIONS OF A BATTERY OF COKE OVENS

[75] Inventor: Wilhelm Stog, Waltrop, Fed. Rep. of Germany

[73] Assignee: WSW Stahl- und Wasserbau GmbH, Waltrop, Fed. Rep. of Germany

[21] Appl. No.: 933,647

[22] Filed: Aug. 14, 1978

[51] Int. Cl.[3] ..... C10B 27/00; C10B 27/04; C10B 27/06

[52] U.S. Cl. ..... 202/257; 202/263; 285/332

[58] Field of Search ..... 202/227, 230, 262, 263, 202/254, 255, 256, 257, 261, 270; 285/332

[56] References Cited

U.S. PATENT DOCUMENTS

| | | | |
|---|---|---|---|
| 3,401,774 | 9/1968 | Krahn | 285/332 X |
| 3,507,522 | 4/1970 | Froman et al. | 285/332 X |
| 3,729,384 | 4/1973 | Kinzler et al. | 202/263 |
| 3,767,536 | 10/1973 | Ikeda et al. | 202/263 |
| 3,785,933 | 1/1974 | Edgar et al. | 202/263 |
| 3,930,961 | 1/1976 | Sustarsic et al. | 202/263 X |
| 3,933,595 | 1/1976 | Gordon et al. | 202/263 X |
| 3,972,780 | 8/1976 | Calderon | 202/263 X |
| 4,087,333 | 5/1978 | Naevestad | 202/263 X |
| 4,146,435 | 3/1979 | Veno et al. | 202/263 X |

FOREIGN PATENT DOCUMENTS

| | | | |
|---|---|---|---|
| 1310980 | 3/1973 | United Kingdom | 202/263 |

*Primary Examiner*—Arnold Turk
*Attorney, Agent, or Firm*—Becker & Becker, Inc.

[57] ABSTRACT

An apparatus for withdrawing and cleaning emissions of a battery of coke ovens, which emissions occur during the filling, coking, especially within the region of the doors, and during the pushing. The battery of coke ovens includes a charging larry with a withdrawal device for the filling gases. This battery is provided with suction conduits located on both sides of the battery and above the doors, while extending in the longitudinal direction of the battery. Connected to the suction conduits are collecting chambers for dust laden gases which rise within the region of the doors. A coke quenching car is displaceable substantially parallel to the battery. The coke quenching car has associated therewith a collecting hood which extends over the coke quenching car and which is provided with a withdrawing device for dust laden gases and vapors. Parallel and in spaced relationship to the battery of coke ovens there is provided a further withdrawing conduit having connected thereto the withdrawing device of the collecting hood associated with the quenching car. On one of the suction lines there is provided a plurality of pipe connections respectively associated with one and with one only of the oven chambers. The withdrawing device of the filling car is respectively connectable to one of the pipe sections, while both suction lines and the withdrawing conduit are connected to a common purifying device and suction blower.

11 Claims, 2 Drawing Figures

APPARATUS FOR WITHDRAWING AND CLEANING EMISSIONS OF A BATTERY OF COKE OVENS

The present invention relates to a device for withdrawing and cleaning of emissions of a battery of coke ovens which emissions occur during the filling and coking, especially within the region of the doors and also occur during the spinning or pushing (Drücken). The battery of coke ovens comprises a charging larry with a withdrawal for the bed or filling gases. The said battery of coke ovens is provided with withdrawing conduits extending on both sides of the battery in the longitudinal direction thereof and being located above the doors, said withdrawing conduits being connected to the collecting chambers for dust laden gases which rise within the region of the doors. A coke quenching car is displaceable substantially parallel to said battery of coke ovens and has arranged thereover a hood which communicates with a withdrawing conduit for dust laden gases and vapors.

With a heretofore known device of the type involved, on the machine side and the coke side of the battery of coke ovens above each door there is respectively provided a collecting chamber which with regard to length and depth is adapted to the distance between two vertical supports and at its bottom side is open for receiving gases which collect within the region of the door therebelow. Expediently, the collecting chamber is provided with a roof-shaped hood so that during the refining, also dust collecting gases rising on the machine side can be safely withdrawn. Also, when in the space between the supports air is blown in for forming a kind of air curtain, on both sides of the battery of coke ovens it will be assured that in each phase of operation, harmful emissions will enter the two withdrawing conduits which are always open and, that such emissions can be conveyed to specific cleaning devices.

It is furthermore known to collect the emissions occurring within the region of a coke oven, by providing relatively small oven chambers with a double walled roof which is in communication with one or more smokestacks. With such an arrangement, merely the possibility exists to convey non-cleaned or non-purified emissions into higher air layers, but nevertheless the ecological pollution remains. Inasmuch as such hoods are not suitable for larger batteries of coke ovens, such hood arrangements were provided only for the coke side of the battery while the hoods or covers extend over the entire length of the battery and thus cover the coke cake carriages, the quenching car and the conveyor belt or coke ramp. The number of structural elements of such covers is considerable while a proper screening or shrouding practically cannot be realized.

For reasons of costs, it has therefore been suggested to provide only the coke cake carriage and the quenching car with a cover or hood. This hood may be arranged on a portal construction which is displaced together with the coke cake carriage. The hood has a streamlined design and is provided with a withdrawing device through which the dust laden gases and vapors which are generated during the spinning or pushing, are conveyed to a purifying device which is arranged on said hood. This cleaning and dust removing device is provided with at least one blower and separator which as a rule is a yielding force-wet dust removing device so that additional storage containers, conduits and control members have to be provided with the humidifying substance. The relatively low expenses for the collecting hood are more than counterbalanced by relatively high expenses for the devices. In order to overcome this drawback, the withdrawing section of the collecting hood has been provided with a connection which conveys the dust laden gases and vapors into a withdrawing conduit which extends parallel to the tracks for the coke cake carriage and the quenching car. Expediently the withdrawing conduit forms a passage open at the top which is covered by a flexible band or the like which is adapted to be lifted off the withdrawing conduit by the withdrawing connection of the collecting hood, in order to be able to pass gases and vapors into the latter. The flexible band may also be provided in the form of lip seals on one side of the withdrawing conduit. The connection of the collecting hood will then be provided with a member which lifts the lips off each other in order to establish a connection toward the inner chamber of the conduit.

Furthermore, within the region of the charging larry filling gases are obtained. The filling gases are usually treated by specific cleaning devices which are arranged on the charging larry. These charging larries require blowers, separators and storage means for the humidifying substance and are therefore relatively expensive particularly since the supports of the batteries of coke ovens have to be designed correspondingly heavier. The requirements as to devices are due also in view of the fact that the filling gases have a rather different composition and in addition to dust also contain tar and other hydrocarbons. In order to reduce the number of corresponding devices, it has been suggested to provide the withdrawing device for the filling or bed gases with a liftable and lowerable and, if necessary also pivotable, pipe connection by means of which a gas-tight connection between the coal bin of the charging larry and a crude gas riser can be established which extends via an elbow joint to the collecting main. The pipe connection may, however, also be connected to a separate withdrawing conduit.

Furthermore, it is known to provide a filling gas main which has a tub-shaped cross section and by means of a partition over its entire length is subdivided into a closed and an open trough while the two troughs are separated from each other by a liquid-tight closure. A U-shaped curved pipe section extends from the charging larry to the open trough through said closure while the upper open end of said pipe section is arranged above the liquid level in the closed trough. The cost for the structural parts in this instance is relatively high. The arrangement requires continual observation.

All of these known arrangements require a greater number of parts inasmuch as for the individual emission sources it is necessary to provide specific cleaning devices and respective separated blowers.

It is, therefore, an object of the present invention to reduce the structural devices and power consumption for the auxiliary devices in connection with a battery of coke ovens.

These and other objects and advantages of the invention will appear more clearly from the following specification in connection with the accompanying drawings, in which.

The above outlined object has been realized by arranging a further withdrawing conduit parallel and in spaced relationship to the battery of coke ovens, while said withdrawal conduit has connected thereto the withdrawal means of the collecting hood associated with the quenching car. The arrangement according to the invention is furthermore characterized in that on one of the suction-off conduits there is provided a plurality of pipe connections one each of which is associated with one of the oven chambers. Furthermore the withdrawal means of the charging larry is adapted respectively to be connected to one of the pipe sections. Both suction lines and the withdrawing conduit are connected to a common cleaning device and suction blower. The arrangement furthermore brings about the advantage that for all three emission sources, namely within the region of the charging larry, within the region of the doors, and within the region of the coke cake carriage as well as within the region of the quenching car only one single suction blower and one single purifying device are necessary. Gases, dust, tar fog and air of all three emission sources are intimately intermixed while in particular the tar fog deposits on the dust particles. The separation of the impurities in the cleaning device can therefore be better controlled and higher degrees of separation of tar fog and dust are obtainable. By introducing the filling gases into one of the always open suction conduits above the doors, also pressure variations are equalized better, especially pressure shocks resulting from explosions within the region of the charging larry, or other pressure variations occurring during the filling operation can without specific supplementing devices be safely caught by the overall arrangement.

As a purifying device, expediently a wet electro-filter may be employed which in addition to separating the tar components, also is able to catch minute dust grain sizes so that in spite of the application of a single purifying device only for the entire battery of coke ovens it is possible to obtain a particularly high separating degree and thereby optimumly cleaned waste gases.

The blower output may furthermore be reduced by providing some of the suction conduits or withdrawing conduits with throttles and/or with shut-off vlaves. In particular, the withdrawal conduit for the dust laden gases and vapors of the collecting hood of the coke cake conveying car and of the quenching car are adapted to be disconnected.

Figure 1:
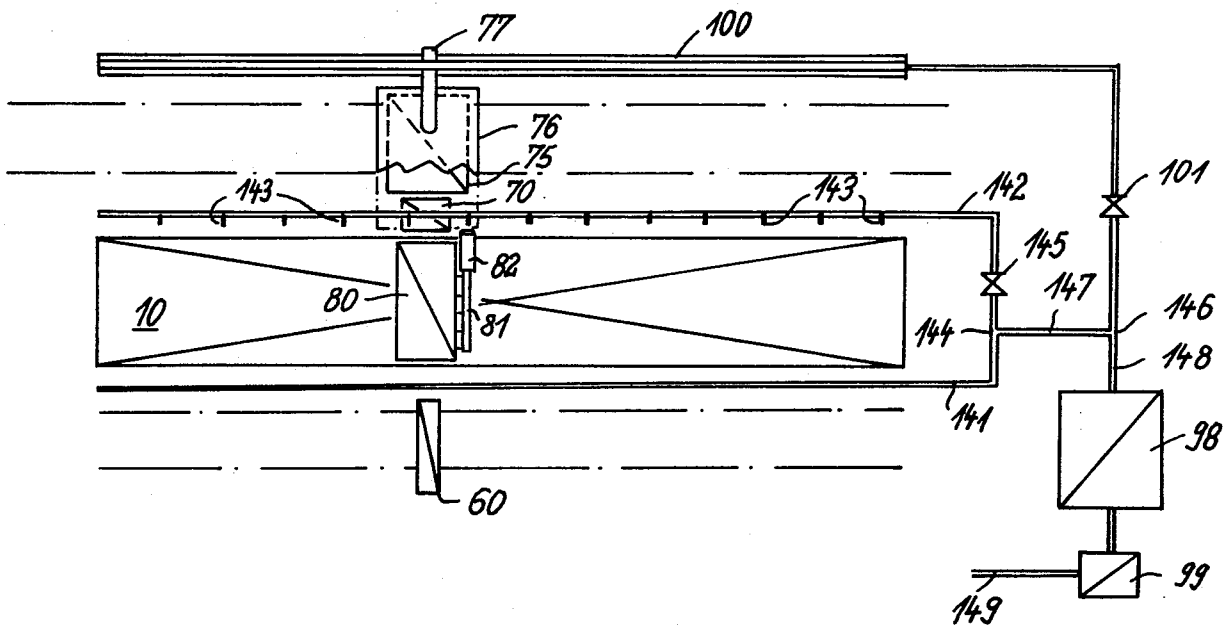
FIG. 1 is a diagrammatic plan view of a battery of coke ovens according to the invention.
Figure 2:
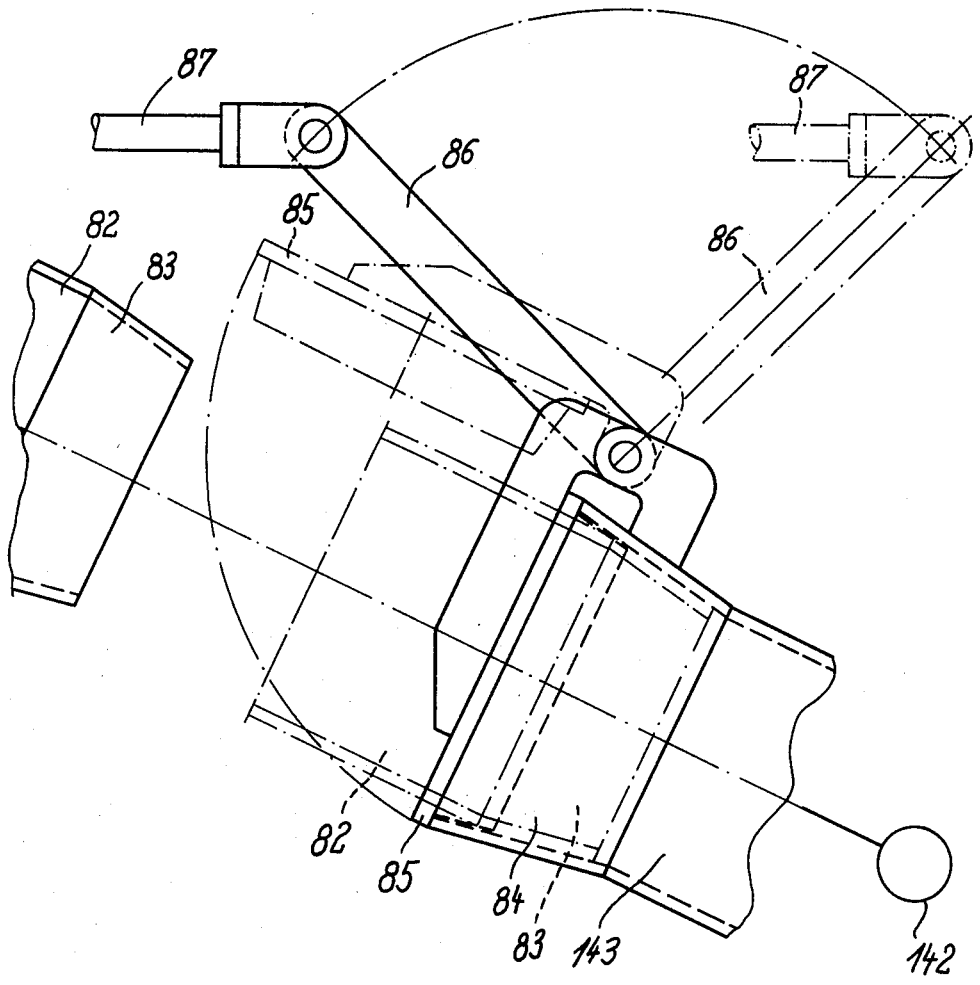
FIG. 2 illustrates a pipe connection for the charging larry.

Referring now to the drawings in detail, FIG. 1 shows a battery 10 of coke ovens with a plurality of non-illustrated oven chambers. Displaceable in the longitudinal direction on the battery 10 of coke ovens is a charging larry 80 which, in a customary manner, comprises a coal bin, a charging funnel, collecting hoods intended for filling gases and associated with said bin and funnel and has a withdrawing means and a collecting conduit 81 for said gases, and a telescopic pipe 82 on said conduit 81. The mouth 83 of the telescopic pipe is truncated cone-shaped and is adapted to be introduced into a correspondingly designed widened section 84 which is provided on the free end of the pipe section 143. The pipe section 143 is provided on a suction line 142 which extends on the coke side along the entire battery 10 of coke ovens. Each individual oven chamber has associated therewith at least one pipe section 143 so that the withdrawal means 81 of the charging layer 80 can after the arrangement thereof above one of the oven chambers be connected with the corresponding pipe sections 143. To this end, a cover 85 is folded off the widened section 84 which cover 85 is movable by a linkage system 86. To this end, a control member 87 adapted to be controlled by the charging larry 80 is brought into engagement with the linkage 86. The control member 87 can directly be coupled to the telescopic movement of the telescopic pipe 82 while, however, it is necessary that, as will be evident from FIG. 2, the cover 85 is first completely folded off from the broadened section 84 prior to the telescopic pipe mouth 83 being able to be moved into he broadened section 84. The filling gases are then completely passed into the pipe section 143 while the underpressure in the suction line 142 will assure the complete and uniform withdrawal of the filling gases.

On the machine side of the battery of coke ovens there is displaceable a machine carriage 60 which in a manner known per se comprises a pusher as well as a leveling rod. Above the doors there are provided collecting chambers for dust laden gases which gases are obtained during the leveling, coking and pushing. These gases pass from the collecting chambers into a suction line 141 which extends in the longitudinal direction of the entire coke oven battery 10.

The two suction lines 141, 142 come together at 144 while, expediently prior to the joining point of said suction lines 141 and 142, a valve 145 is provided in the suction line 142. The suction line 142 with the pipe connection 143 for receiving the filling gases is expediently designed for a greater air volume than the suction line 141 in which only the dust laden gases are collected which are gathered on the machine side.

Parallel to the battery 10 of coke ovens and on the coke side there are displaceable a coke carriage 70 and a quenching car 75. Both the carriage 70 and the car 75 are covered by a collecting hood 76 which is displaceable with the carriage 70 and/or the quenching car 75. The collecting hood 76 comprises a withdrawing device 77 which conveys the gases and vapors occurring during the quenching, into a withdrawing line 100. The line 100 and the withdrawing device 77 may be so designed that for instance by means of elastic cover elements at each spot in the course of the withdrawing line 100 there is safeguarded a connection between the withdrawing device 77 and the inner chamber of line 100. In view of the underpressure in the withdrawing line 100, independently of the position of the coke cake carriage 70 and of the quenching car 75, the dust laden gases and vapors collected in the hood 76 are uniformly and completely withdrawn. The line 100 comes together at 146 with a line 147 which comes from the joining point 144 of the two suction lines 141, 142. Within the region of the withdrawing device 77 and in the withdrawal line 100 there is provided a choke or shut-off valve 101. From the joining point 146, a conduit 148 leads to a mixing chamber 140 and to a purifying device 98 which is followed by a suction blower 99. From the suction blower 99 the cleaned air passes through a conduit 149 to a chimney (not shown) or is conveyed anew through a further conduit 150 to the battery 10 of the coke ovens in order, for instance, to generate a kind of air curtain within the region of the coke oven doors. The cleaning device 98 is expediently a wet-electro filter adapted to separate minute dust particles. Between the joining point 146 and the cleaning device 98, a mixing chamber (not shown) may be provided in the conduit 148. This mixing chamber makes possible the different emissions to intermix even to a greater extent, and thereby to bind tar fog and other hydrocarbons to the dust particles. Such mixing chamber is not necessary because already in the conduits themselves an intermixing is effected, and in particular in the suction line 142, directly after the introduction of the filling gases, a binding of the tar fog occurs.

The suction blower 99 is expediently so designed as to be controllable, and it is possible to reduce its output by turning off the valves 101 and 145. The control of these elements is effected in conformity with the program of operation of the battery 10 of coke ovens. Inasmuch as when employing one machine car 60 only, the latter, the charging larry 80, the coke cake carriage 70, and the quenching car 75 are aligned with regard to one and the same oven chamber, it will be appreciated that only alternatively a pushing and filling is effected. In contrast thereto, the valve 101 has to be opened fully only during the pushing, whereas the valve 145 in line 142 may be partially closed inasmuch as no filling gases collect. If on the other hand a filling operation is carried out, the valve 145 is fully opened, and the valve 101 may be closed because the quenching car 75 is on its way to or from the quenching tower. At any rate, residual gases are to be sucked off from the hood 76 and the conduit 100 so that it may be expedient not to close valve 101 completely but always to maintain a certain underpressure in the withdrawing line 100.

The suction lines 141, 142 are always open within the region of the suction chambers. In the suction line 142, this brings about the advantage that pressure variations during the withdrawal of the filling gases, can be compensated automatically. The requirement in devices and control means for the operation of the battery 10 of coke ovens is thus considerably reduced, while the purification of the emissions could be considerably increased, inasmuch as impurities can be separated which could not be captured with heretofore known devices of the type involved, and thus not extracted.

It is, of course, to be understood that the present invention is, by no means, limited to the specific showing in the drawings, but also comprises any modifications within the scope of the appended claims.

What is claimed is:

1. In combination with apparatus for making coke including a battery of coke ovens, means for withdrawing and cleaning emissions of said battery of coke ovens, which emissions occur during the filling, coking, especially within the regions of the doors of said ovens, and during the pushing, in which said means for withdrawing and cleaning emissions of said battery of coke ovens comprises: a machine carriage, a charging larry displaceable in the longitudinal direction on said battery of coke ovens with withdrawal means for the filling gases, two suction conduits one located on each side of said battery of coke ovens and above said doors while extending in the longitudinal direction of said battery of coke ovens and both suction conduits coming together at a first joining point, collecting chambers connected to both of said suction conduits for collecting dust laden gases rising within the region of said doors, said means for withdrawing and cleaning emissions of said battery of coke ovens also including a coke cake carriage and a coke quenching car which are both displaceable substantially parallel to and on the coke side of said battery of coke ovens and having associated therewith a collecting hood which extends over the coke quenching car and which carries emissions withdrawing means, a withdrawing conduit extending parallel and arranged in spaced relationship to said battery of coke ovens and having connected thereto said withdrawing means of said collecting hood, one of said suction conduits being provided with a plurality of pipe connections respectively associated with one and with one only of said oven chambers, said withdrawal means of said charging larry being respectively connectable to one of said pipe connections for introducing said filling gases into said respective suction conduit for mixing said filling gases and said dust laden gases rising within the region of said doors within said respective suction conduit while both suction conduits and said withdrawing conduit are connected at a second joining point upstream of a common purifying device and suction blower.

2. An apparatus in combination according to claim 1, in which said suction conduit comprising said pipe connections is designed for a greater air volume than that other suction conduit.

3. An apparatus in combination according to claim 1, in which said suction conduit comprising said pipe connections is designed for a greater air volume than said other suction conduit, and is prior to the area of said first joining point where it meets the other suction conduit provided with a first valve.

4. An apparatus in combination according to claim 1, in which said withdrawing conduit prior to said joining point where it joins a connecting conduit of said suction conduits is provided with a second valve.

5. An apparatus in combination according to claim 1, in which said suction conduit comprising said pipe connections is designed for a greater air volume than said other suction conduit, and is prior to said first joining point provided with a first valve, and in which said withdrawing conduit prior to said second joining point is provided with a second valve, said second vlave being adapted to be closed to at least a major extent one of said ovens is being filled.

6. An apparatus in combination according to claim 1, in which said withdrawing conduit is provided with a cover adapted at any position in the course of said withdrawing conduit to effect a permanent connection between said emissions withdrawing means of said collecting hood and siad withdrawing conduit.

7. An apparatus in combination according to claim 1, in which an open end of said pipe connections of said suction conduit is provided with a truncated cone-shaped widened portion and has associated therewith a cover for closing said widened portion, said cover being associated with a linkage and an adjusting member operable from said changing larry, said withdrawal means of said charging larry being provided with a telescopic pipe having a mouth which is truncated cone-shaped and is insertable into said widened portion.

8. An apparatus in combination according to claim 1, in which said pipe connections are arranged on that suction conduit which extends along the coke side of said battery of coke ovens.

9. An apparatus in combination according to claim 1, which includes said common purifying device and said suction blower and also includes a mixing chamber prior to said purifying device and said suction blower.

10. An apparatus in combination according to claim 9, in which said purifying device is represented by a wet-electro filter.

11. An apparatus in combination according to claim 9, which includes a conduit connected to said suction blower and leading to the doors of said battery of coke ovens for forming an air curtain.

* * * * *